US005930853A

United States Patent [19]

Akado

[11] Patent Number: 5,930,853

[45] Date of Patent: Aug. 3, 1999

[54] BATH FOR USE WITH A BED FOR THE SICK

[75] Inventor: Koji Akado, Koshigaya, Japan

[73] Assignee: Akado Co., Ltd., Japan

[21] Appl. No.: 08/929,931

[22] Filed: Sep. 15, 1997

[30] Foreign Application Priority Data

Sep. 17, 1996 [JP] Japan ..... 8-244516

[51] Int. Cl.[6] ..... A47K 3/00

[52] U.S. Cl. ..... 4/547; 4/585; 5/900

[58] Field of Search ..... 4/546, 547, 585, 4/564.1, 565.1, 566.1; 5/88.1, 503.1, 900

[56] References Cited

U.S. PATENT DOCUMENTS

| | | | |
|---|---|---|---|
| 2,788,527 | 4/1957 | Steven | 4/565.1 |
| 2,798,229 | 7/1957 | McQuown . | |
| 3,373,451 | 3/1968 | Schmidt | 4/585 |
| 4,930,169 | 6/1990 | Davison | 4/546 X |
| 5,054,136 | 10/1991 | Inagaki | 4/547 X |
| 5,235,712 | 8/1993 | Smith | 4/585 X |

FOREIGN PATENT DOCUMENTS

| | | |
|---|---|---|
| 1-85650 | 3/1989 | Japan . |
| 4-215757 | 8/1992 | Japan . |
| 7-8522 | 1/1995 | Japan . |

*Primary Examiner*—Charles E. Phillips
*Attorney, Agent, or Firm*—Faegre & Benson LLP

[57] ABSTRACT

A bath for use with a bed for the sick includes a flexible bag body that is formed to hold liquid therein. The flexible bag body has an opening and four support bar inserting paths formed along an edge of the opening. The opening is squared rigidly by supporting bars that are inserted within the supporting bar inserting paths. The supporting bars, while inserted in the supporting bar inserting paths, are removably supported on a bed frame. The bath of the present invention can be prepared at a low cost, and, after removing the bag body from the bed, can be folded small so as to need only a small storage space. Also, since the bag body is freely deformable and light-weight, it is easier to handle during mounting, removing and cleaning.

2 Claims, 9 Drawing Sheets

BATH FOR USE WITH A BED FOR THE SICK

BACKGROUND OF THE INVENTION

1. Field of Invention

This invention relates to a bath for use with a bed for a sick person (hereinafter referred to as "the sick").

2. Prior Art

There have been many beds with a bath for the sick disclosed. For instance, in the bed with a bath for the sick disclosed in the Japanese patent laid-open publication No. Hei 4-215757, the bath is supported shrinkably in the vertical direction with a supporting member and when it is not used, it is shrinked in its height and accommodated under a bed by drawing it along a rail, and when taking a bath, it is drawn out to the side of the bed along the rail and elongated in its height to use the bath. The opening of the bath is squared using four supporting bars (hereinafter referred to as "squared"). Further, in Japanese patent publication No. Hei 3-37942, a squared bath, which is able to be drawn in and out under a bed, is disclosed, and, as a popular bed with a bath for the sick, a squared bath is fixed under the bed and the bed is descended into the bath, and the sick can therein take a bath.

Now, since the above conventional bath for use with a bed for the sick is squared, the cost of manufacturing such a bath is expensive. In the case of the type of bath which is drawn in and out under a bed, it also becomes necessary to provide members for supporting the bath and an operating mechanism thereof. The problem is the high cost of manufacturing such a bed for the sick as it becomes even higher. In addition, if the bath is to be prepared in a rental manner, in the case where the bath is squared rigidly, it occupies a large space, so that it is inconvenient to carry.

Further, in the case where such beds are used in hospitals or general homes, when the sick recover, the baths become unnecessary and it is desirable to use the bed in a normal manner. But, if the baths are squared rigidly, they will tend to occupy a large amount of storage space. In addition, the bath always has to be kept clean. In particular, if the bath is to be prepared in a rental manner, since many people use the same bath, such bath is expected to be newly prepared for each use, but actually it is not possible to prepare a squared bath at each time of use due to the expensive cost of doing so, which causes in that case a problem concerning its cleanness. Also in the case where such bath is used in a rental manner in hospitals or general homes, it has been a problem to pursue an ample cleaning since the bath has to be cleaned indoors, and the squared bath can not be removed from the bed, which makes it difficult to avoid the spatter of water.

The present invention has been done in the light of the above problem, and the object thereof is to provide a bath for use with a bed for the sick, which is low in cost, easy to replace and clean, miniaturized in size and has increased handling efficiency.

SUMMARY OF THE INVENTION

In order to solve the above problem, a bath for use with a bed for the sick is disposed under a bed consisting of a bed mat put on a bed frame and arranged in such a manner that the bed can descend into the bath with the sick lying on the bed so that the sick can take a bath. The bath is characterized in that it is formed from a flexible bag having an opening, wherein the edge of the opening of the bag is made square.

On each side edge of the square opening, a supporting path is formed in which a supporting bar is to be inserted in and out. Thus, the supporting bars can be inserted in the four paths and can be removably supported on the frame of the bed.

Further, the bath for use with a bed for the sick is characterized in that a bottom of said bag can be supported on an inclined stand.

Next, it is explained how the above problem to be solved by the present invention can be recognized from the means described below. First, in accordance with the present invention, a bath is disposed under a bed, and it is arranged in such a manner that the sick can take a bath by making the bed descend into the bath. The bath with a bed for use of the sick is formed with a flexible bag body, which is indefinite in its shape and can be folded small. And, since the opening of the bag body is made square and each side edge of the opening is formed with a cylindrical path (hereinafter referred to as a "path"), in which a supporting bar is inserted in and out, when the supporting bars are inserted in these paths, the opening of the bag body can be squared rigidly, and when such supporting bars are drawn out, the bag body can be folded. In addition, since the supporting bars are supported removably on the frame of the bed, the bag body can be removably supported on the bed frame.

Also in accordance with the present invention, the bottom of the bag body is supported on an inclined stand, and when water is poured into the bag body, the bottom of the bag body becomes flat as its shape freely changes while being supported on the stand so that the weight of the water is supported by the stand.

In practicing the present invention, as shown in FIG. 11, a bath 5 is disposed under a bed frame 1 on which a bed mat is put. In order for the sick to take a bath, the bed frame 1 can descend in the bath 5 with the sick lying on the bed. The bath 5 is, as shown in FIG. 1, formed in a flexible bag body 14. An opening edge of this bag body 14 is made square, and on the four edges of the opening, supporting bar inserting paths 15, 16 (only two paths are shown) are formed, where the supporting bars 17 and 18 (only two bars are shown) are inserted in and out. As shown in FIG. 4, an end of the supporting bar 18 inserted in the supporting bar inserting path 16 is supported removably on the frame 19 and the end of the supporting bar 17 is supported on the supporting bar 18, and as a result, the bath 5 is substantially removably supported on the frame 19.

Also in practicing the present invention, as shown in FIG. 4, a bottom of the bag body 14 is supported on an inclined stand 20.

EMBODIMENT

Figure 11:
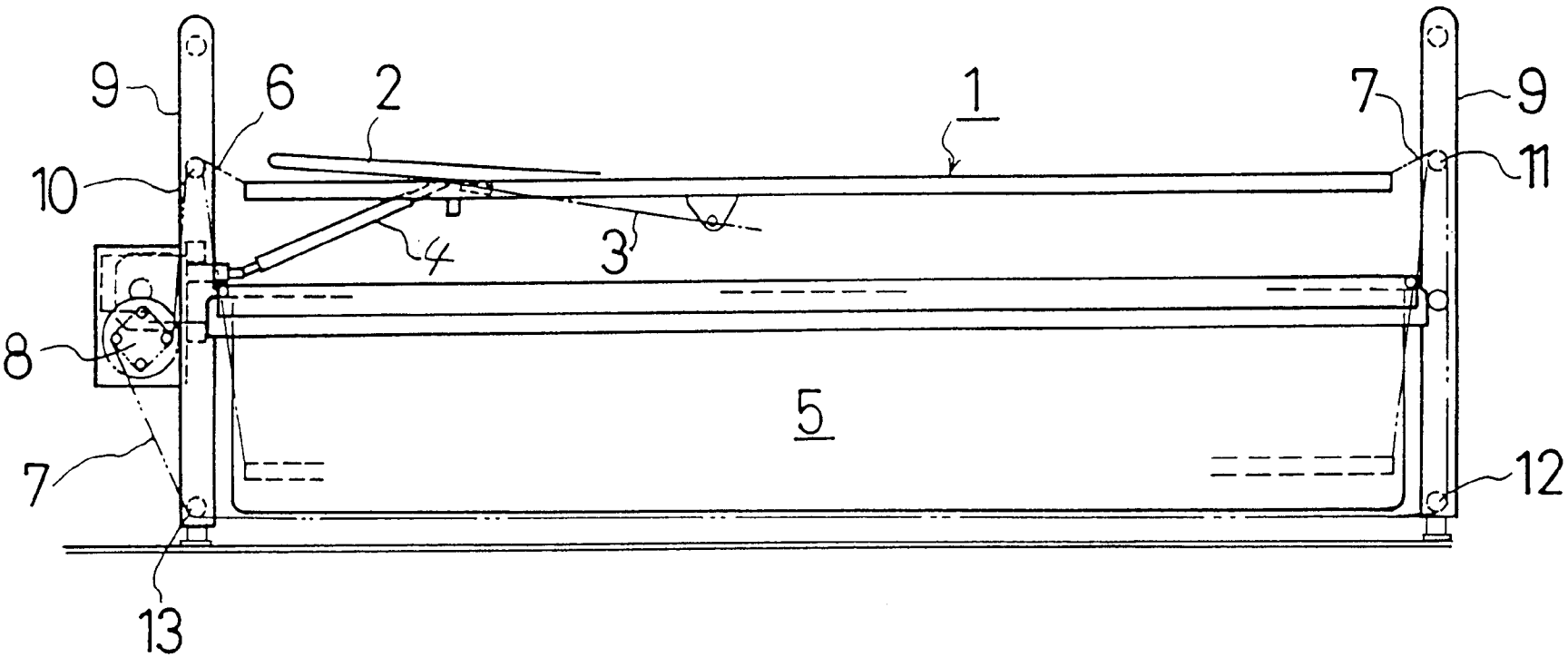
FIG. 11. is a side view of a representative example of a bath for use with a bed for the sick.

Hereinafter, an embodiment of the present invention is explained. In FIG. 11, a bath 5 is provided under a frame 1 on which a bed mat (not shown) is put. One end of this frame 1 is mounted by one end of a belt 6 for ascending and descending the frame 1. The other end of the belt 6 is fixed on a belt wheel 8 through a roller 10 mounted on a frame body 9. On the other hand, on the other end of the frame 1, one end of a belt 7 for ascending and descending the frame 1 is mounted to the frame 1. The other end of the belt 7 is fixed on the belt wheel 8 through rollers 11, 12 and 13 mounted on the frame body 9. In operation when the belt wheel 8 is rotated, the frame 1 descends approximately horizontally from the upper side to the inner side of the bath 5 or ascends in a reverse manner from the inner side to the upper side of the bath 5. A back rest 2 is provided on the frame 1 that can be operated for reclining by rotating a spline shaft 4 to turn a screw bar 3.

Figure 1:
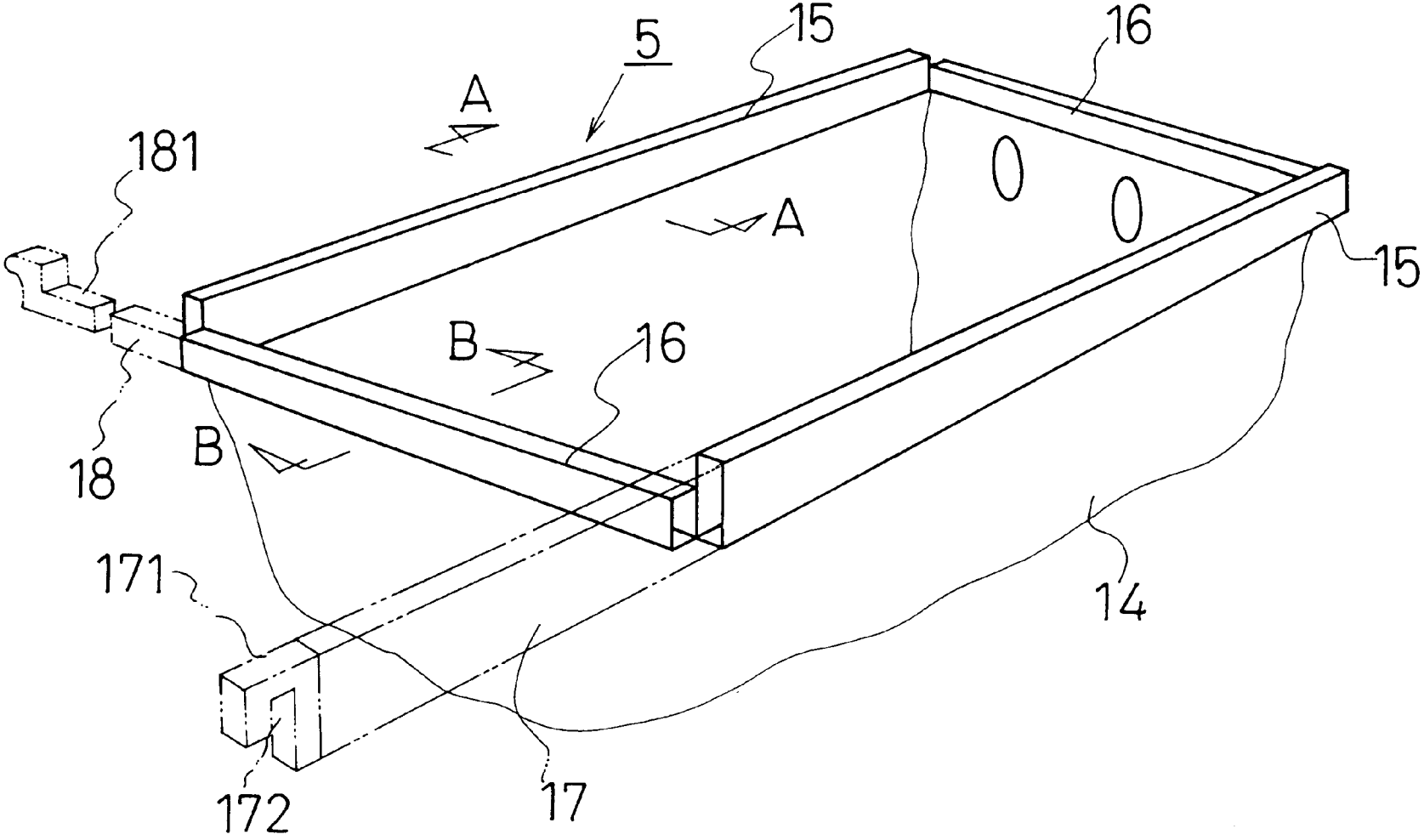
FIG. 1 is a perspective view of the described embodiment of the present invention.
Figure 2:
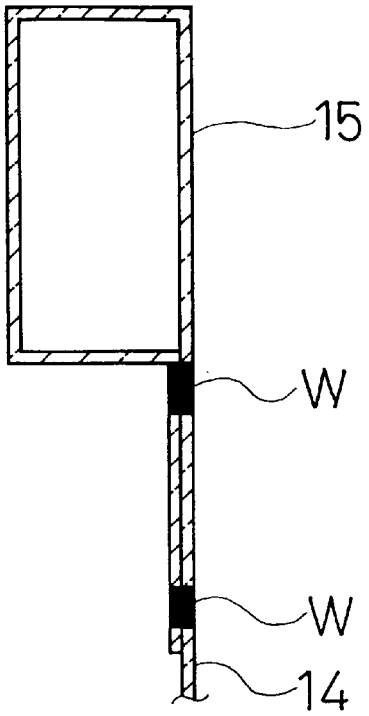
FIG. 2 is a vertical view in section taken along line A—A of FIG. 1.
Figure 3:
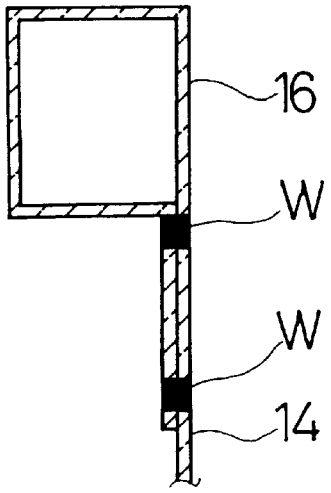
FIG. 3 is a vertical view in section taken along line B—B of FIG. 1.

Next, the bath 5, as shown in FIG. 1, is made from a bag body 14 made of flexible material. Supporting bar inserting paths 15 and 16 are provided on the edge of the opening of the bag body 14. By inserting a supporting bar 17 and a supporting bar 18 into the inserting paths 15 and 16, respectively, the opening is squared rigidly. In FIG. 1 and FIGS. 2 and 3 (which are sectional views taken along the lines A—A and B—B, respectively, of FIG. 1), the supporting bar inserting paths 15 and 16 are shown as having a square cross section. Such supporting bar inserting paths 15 and 16 are formed by welding or melting at W (shown in FIGS. 2 and 3) portions of the bag body 14 together. Accordingly, the supporting bar inserting paths 15 and 16 can be free in the sectional shape so that supporting bars 17 and 18 having a round, instead of square, cross section can be inserted.

Figure 4:
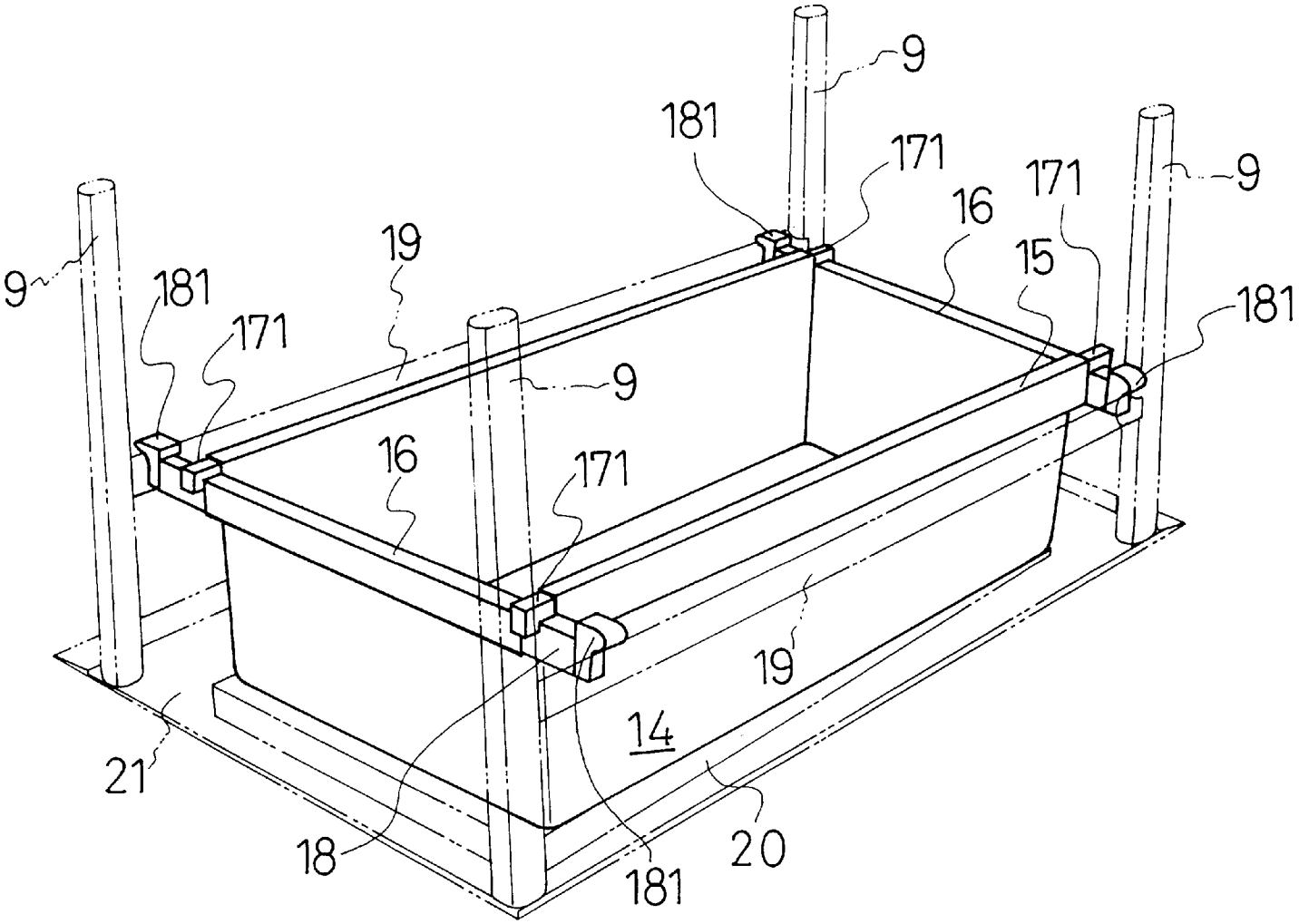
FIG. 4 is a perspective view showing the state where a bag body of FIG. 1 is supported on a bed frame.
Figure 5:
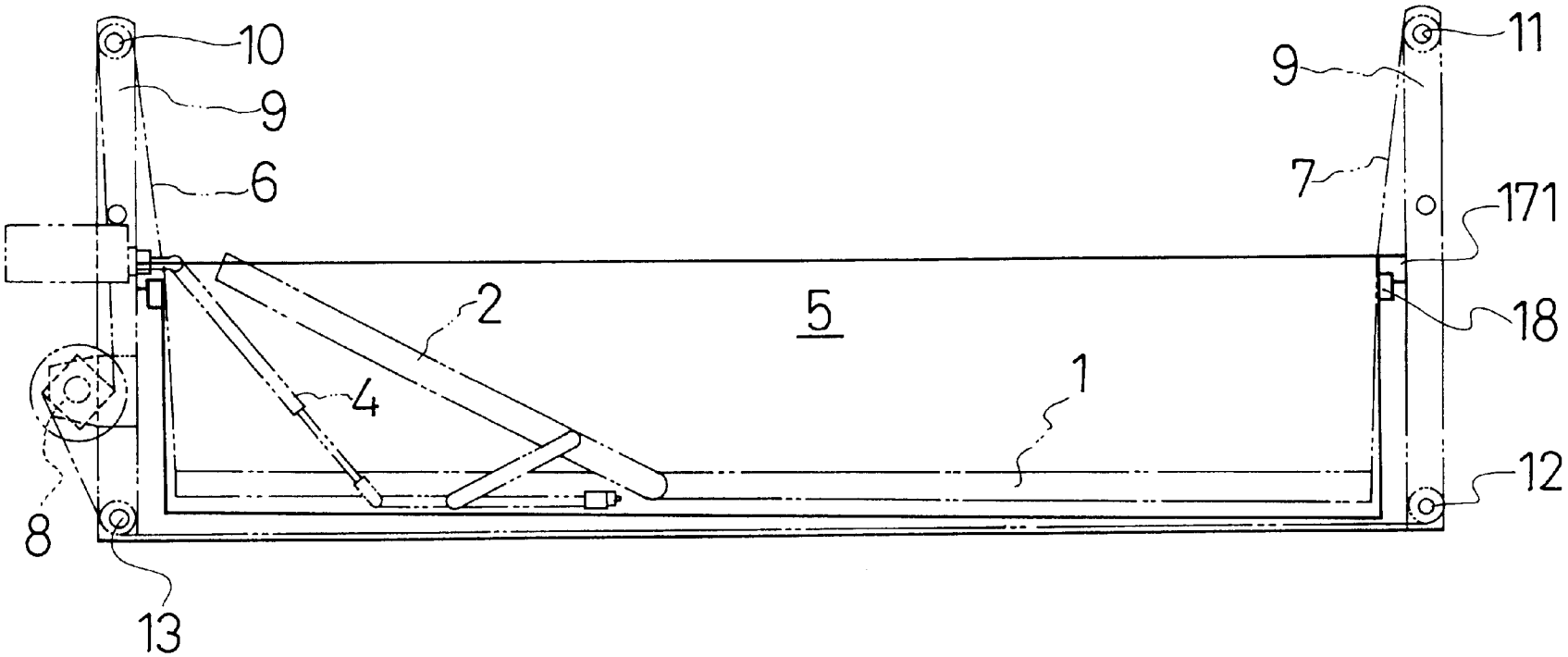
FIG. 5 is a side view showing the relation between the ascending and decending frame and the bag body shown in FIG. 1.
Figure 6:
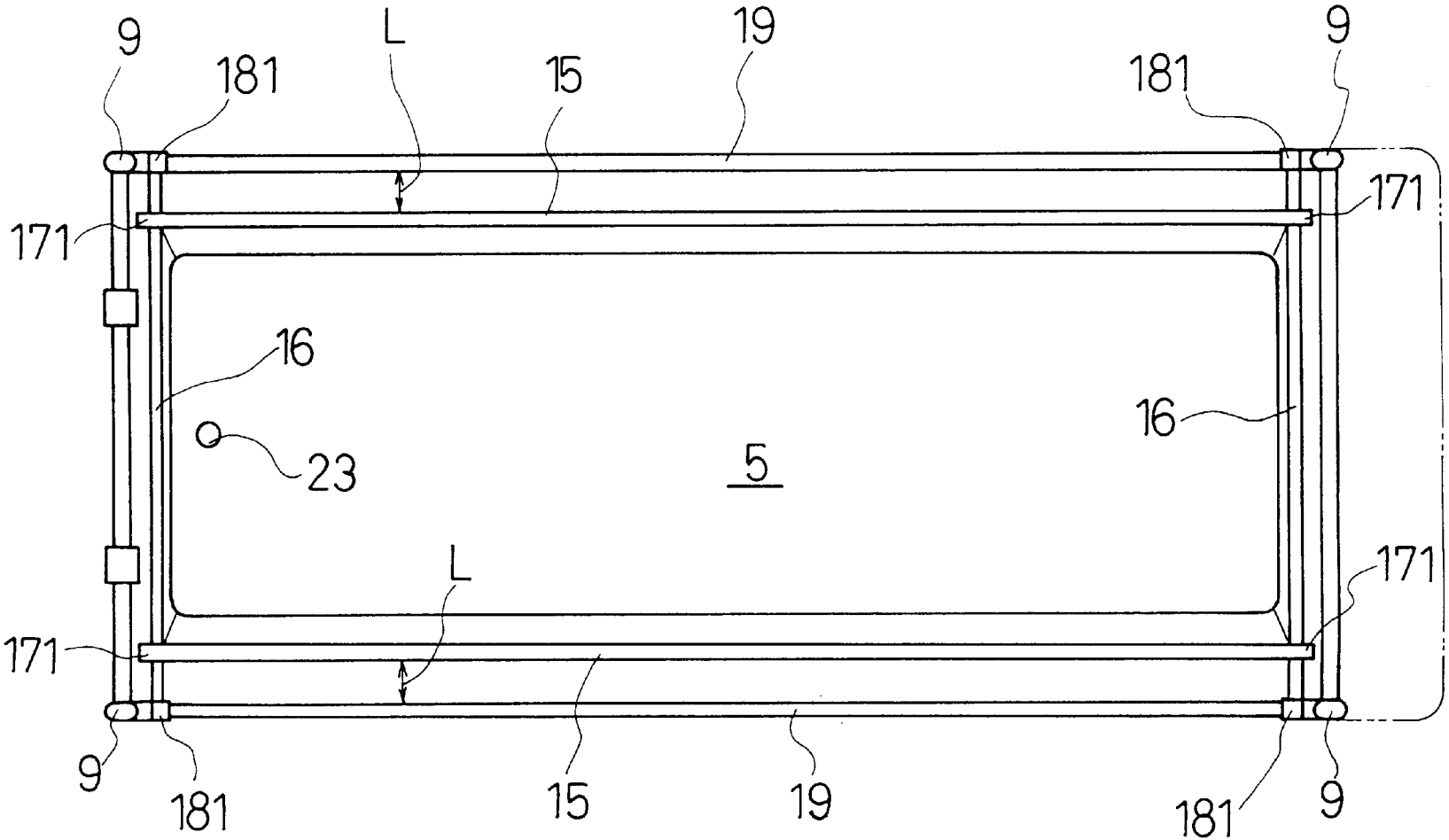
FIG. 6 is a plan view of FIG. 5 omitting the ascending and decending frame.
Figure 7:
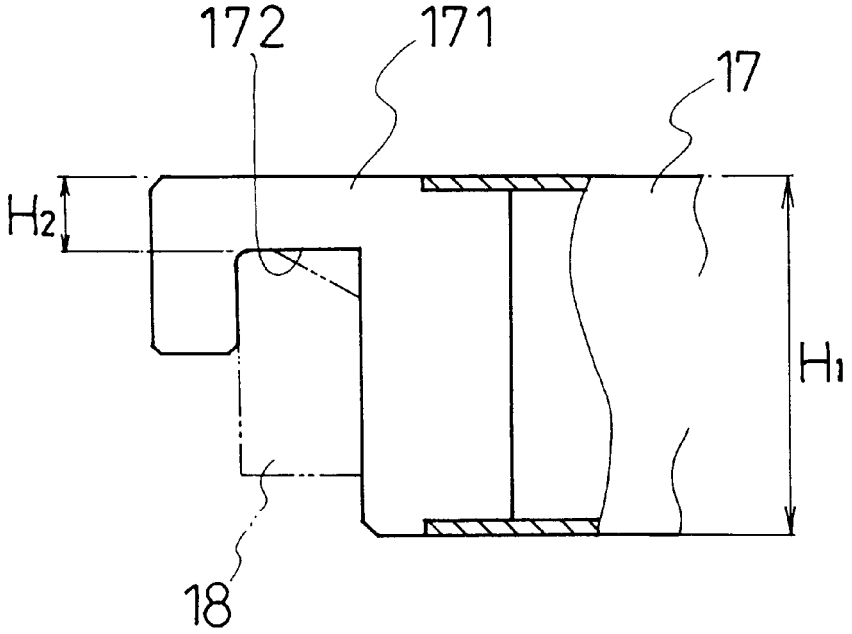
FIG. 7 is a partial sectional view of an end of a supporting bar of one side of FIG. 1.
Figure 8:
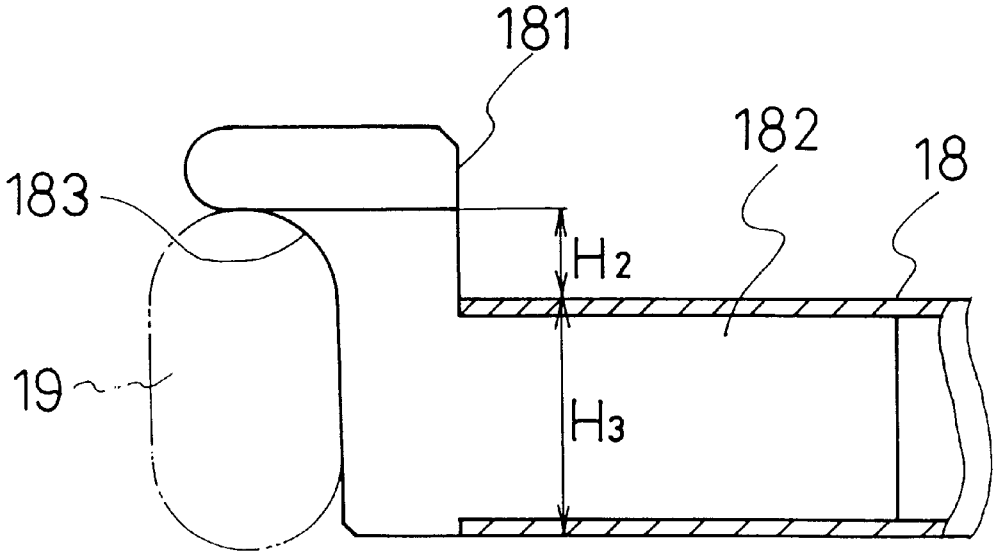
FIG. 8 is a partial sectional view of an end of the supporting bar of another side of FIG. 1.

FIG. 7 shows an end of the supporting bar 17, where a connector 171 having a concave portion 172 to be connected to the supporting bar 18 is secured. Further, FIG. 8 shows an end portion of the supporting bar 18, where a connector 181 having a connecting portion 183 to be connected to the frame 19 is provided to be free in inserting or drawing out of the supporting bar inserting paths 16. The height H3 of the supporting bar 18 is arranged to be lower than the height H1 of the supporting bar 17 shown in FIG. 7. If the height H2 of a concave portion of the connector 171 in FIG. 7 is made equal to the height H2 from the frame 19 in FIG. 8, the supporting bar 17 and the frame 19 can become leveled with each other, which makes it easier for a nurse to help the sick take a bath. FIGS. 5 and 6 show the manner in which the embodiment of the present invention is applied to the bed provided with the bed frame 1 shown in FIG. 11. The bed frame 1 is adapted to descend from the upper portion to the lower portion of the bath 5 and ascend from the lower portion to the upper portion thereof by the belts 6 and 7 for ascending and descending. Further, as shown in FIG. 6, the connectors 181 provided on both ends of the supporting bar 18 are connected to the frame 19 and the connectors 171 provided on both ends of the supporting bar 17 are connected to the supporting bar 18. Thus, the opening of the bath 5 is substantially supported on the frame 19. Further, as shown in FIG. 4, the frame body 9 is planted on a receiving pan 21 and a stand 20 is put on this pan 21 to support the bottom of the bag body 14. Accordingly, the total weight of the water in the bath 5 and the bed is received by the total area of the receiving pan 21, so that, since the weight per unit area is minimized, such bed can be put on straw mattings (tatami) for example. In addition, by providing the receiving pan 21, it can serve as a spattering water receiver and also serve as a receiver of the water that may leak from the bath due to accidental piercing of the bath, which helps avoid water flowing onto the floor.

Figure 9:
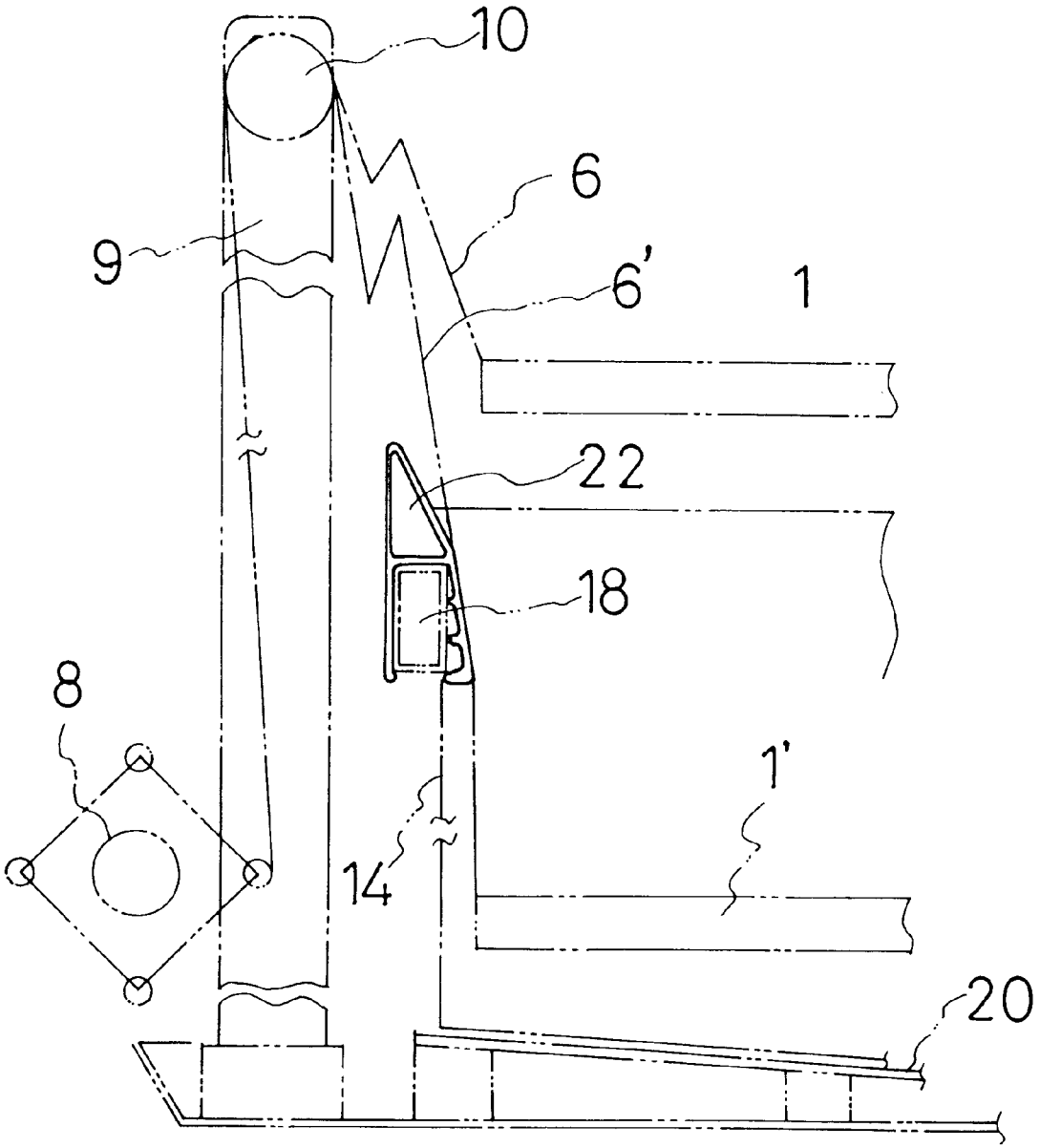
FIG. 9 is an enlarged view of the left side of FIG. 5 showing the state where one protective member is inserted in the inserting path of the supporting bar.
Figure 10:
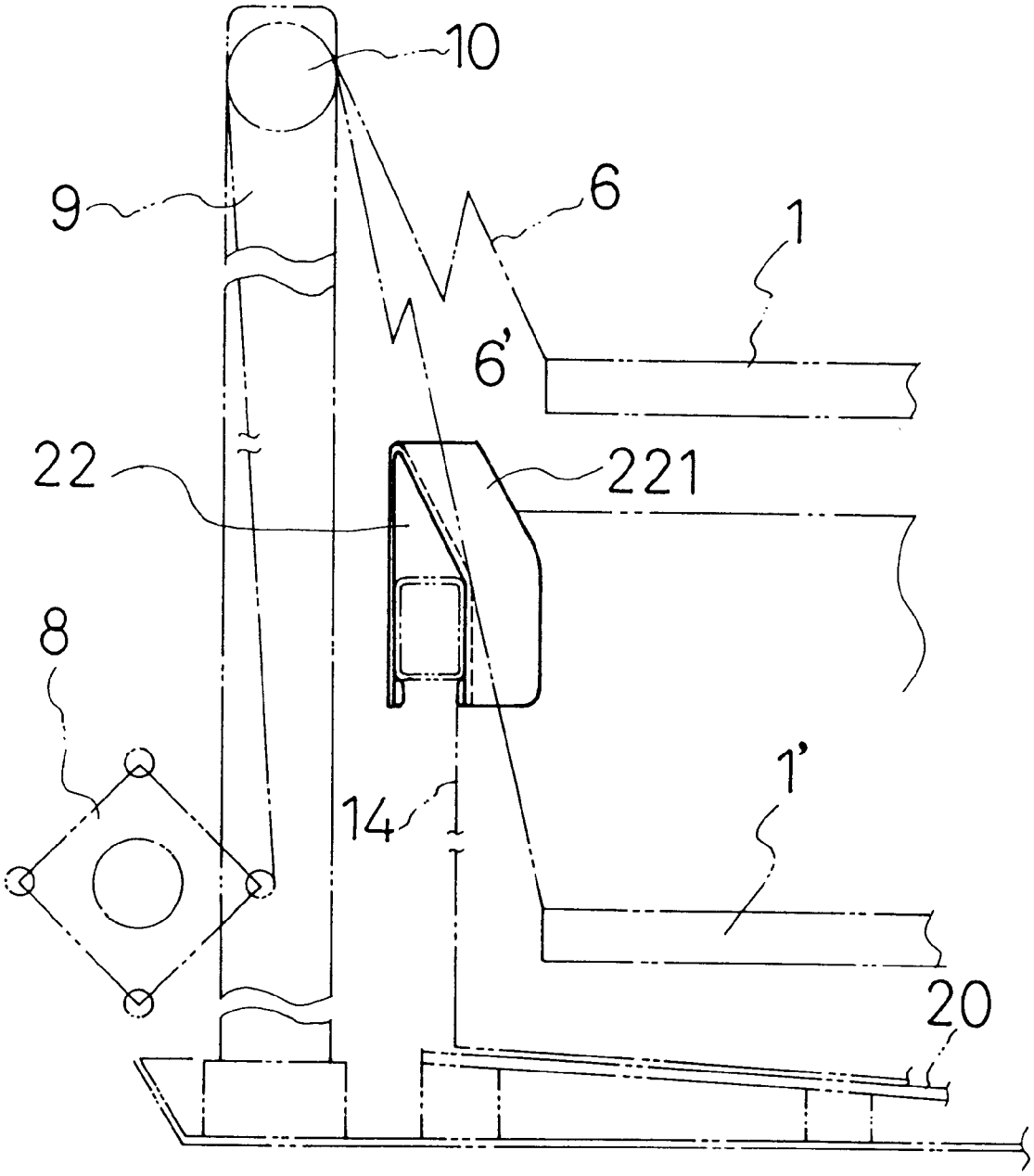
FIG. 10 is an enlarged view of the left side of FIG. 5 showing the state where another protective member is inserted in the inserting path of the supporting bar.

As shown in FIGS. 9 and 10, a protecting member 22 is coupled with the supporting bar inserting path 16 in which the supporting bar 18 is to be inserted. Protecting member 22 is arranged to prevent the ascending and descending belt 6 from abrasion directly against the supporting bar inserting path 16 and damaging it. The protective member 22 is, as shown in FIG. 10, provided with a guide member 221 in a unit to prevent the belt 6 from displacing the protective member 22. FIGS. 9 and 10 show merely the side where the belt 6 of FIG. 11 is located; but it is to be understood that on the side where the ascending and descending belt 7 is disposed, the supporting bar inserting path 16, in which the supporting bar 18 is to be inserted, is also removably coupled with a protective member 22.

Next, the function of the foregoing embodiment of the present invention is explained. As shown in FIG. 1, since the bath 5 is made from flexible material, the bath can be folded small when in the state where the supporting bars 16 and 17 are not inserted in the supporting bar inserting paths 15 and 16. Next, when the supporting bars 17 and 18 are inserted in the supporting bar inserting paths 15 and 16, the opening of the bag body 14 is squared rigidly. When making the opening square rigidly, first the supporting bar 17 is inserted in the supporting bar inserting path 15 and the concave portion 172 of the connectors 171 provided on both ends of the supporting bar 17 is aligned with the opening of the supporting bar inserting path 16; then, the supporting bar 18 is inserted in the supporting bar inserting path 16 through the concave portion 172.

Thus, since the supporting bar inserting paths 15 and 16 are formed along the edge of the opening of the bag body 14, it is possible to make the opening of the bag body 14 square rigidly by simply inserting the supporting bars 17 and 18 in the supporting bar inserting paths 15 and 16. In addition, the bag body 14 can be folded, and since the supporting bars 17 and 18 can be drawn out from the paths 15 and 16 and used in another bag body 14, it is possible to replace a used bag body 14 with a clean one by providing a plurality of bag bodies, like with the replacement of bed sheets.

As described above, after the supporting bars 17 and 18 are inserted in the supporting bar inserting paths 15 and 16, a connector 181 is inserted in both ends of the supporting bar 18 and fixed thereon. And, as shown in FIG. 4, by connecting the connecting portion 183 of each connector 181 to the frame 19, the rigidly squared opening of the bag body 14 can be fixed on the frame 19.

As shown in FIG. 11, by lifting the bed frame 1, on which the bed mat is put, to a height higher than the upper edge (frame 19) of the bath 5, a space between the frame 19 and the bed frame 1 is made, and thereby as shown in FIG. 6, since there is a gap L (since the bed frame 1 is inserted within the bath 5, a further space is made between the bed frame 1 and the frame 19) between the supporting bar inserting path 15 of the rigidly squared opening of the bag body 14 and frame 19, the connector 181 can be connected to the frame 19 and the opening of the bag body 14 can be supported on the frame 19 as the sick lies on the bed mat. In addition, the connector 181 can be removed from the frame 19, and, while the sick lies on the bed mat, the bag body 14 can be removed from the frame 19.

Next, when pouring water in the bag body 14 at the time of taking a bath, as shown in FIGS. 4, 9 and 10, the bottom portion of the bag body 14 is put on the inclined stand 20 and since the bag body 14 is made from a flexible material, the bottom portion is deformed freely along the stand 20, which forms an inclined bottom of the horizontal bath 5, the bottom of which is inclined toward a drain 23 (FIG. 6) of the bag body 14. And, since the weight of the stocked water is received by the stand 20, the large load is not added to the supporting bars 17 and 18, so that it becomes easy to replace the bath 5 (bag body 14) because the bars 17 and 18 can be light-weight.

According to the present invention recognized from the detailed explanation above, a bath can be prepared at a low cost and folded small to fit in a small storage space since the bath is made from a flexible bag body that can be configured indefinitely. Also, since the bath is freely deformable and light-weight, it is easier to handle when mounting, removing and cleaning it.

In addition, the bath makes use of the flexible nature of the bag body since the opening edge of the bag body is rigidly squared by inserting the supporting bars in the supporting bar inserting paths formed on the edge of the opening of the bag body and the bath can be folded after drawing the supporting bars out of the paths. Further, since the supporting bars inserted in the supporting paths are supported removably on the bed frame, the bag body, i.e. the bath, can be easily replaced.

Also, according to the present invention recognized from the detailed explanation above, since the bottom of the bag body is supported on the inclined stand, the bottom of the bag body can deform freely along the stand and support the weight of the water poured in the bag body. Thus, the load on the supporting bars becomes light-weight so that the size of the bag body can be small, easily replaced, and prepared at a low cost.

What is claimed is:

1. A bath for use with a bed for the sick, the bed having a bed mat vertically adjustably supported by a bed frame so that the sick can lie on the bed mat while the bed mat is lowered into the bath, the bath comprising a flexible bag body formed to hold liquid therein and having an opening, the flexible bag body also having four support bar inserting paths formed along an edge of the opening, wherein the opening is squared rigidly by supporting bars, inserted within the supporting bar inserting paths, and the supporting bars, while inserted in the supporting bar inserting paths, are removably supported on the bed frame.

2. A bath according to claim 1, wherein the bed frame further comprises a stand positioned below the bag body on which the bag body is also supported.

* * * * *